United States Patent [19]

Geaney

[11] 4,004,584

[45] Jan. 25, 1977

[54] FACIALLY-WORN BREATHING FILTER

[75] Inventor: Sheila A. Geaney, Dundalk, Ireland

[73] Assignee: Alleraid Company, Inc., Ithaca, N.Y.

[22] Filed: July 28, 1975

[21] Appl. No.: 599,665

[52] U.S. Cl. ..... 128/140 N; 128/146.2

[51] Int. Cl.[2] ..... A62B 23/06

[58] Field of Search ..... 128/140 N, 140 R, 142.6, 128/146.2, 146.6, 146.7, 155, 156, 132 D; 55/487, DIG. 33, DIG. 35, DIG. 31, 525

[56] References Cited

UNITED STATES PATENTS

| | | | |
|---|---|---|---|
| 1,359,073 | 11/1920 | King et al. | 128/146.6 |
| 3,049,121 | 8/1962 | Brumfield et al. | 128/146.2 |

*Primary Examiner*—Robert W. Michell
*Assistant Examiner*—Henry J. Recla
*Attorney, Agent, or Firm*—Bruns & Jenney

[57] ABSTRACT

A nasal filter has a filter layer of very fine monolayer metallic mesh supported on either side by a support layer of coarser metallic mesh, the layers being shaped to cover the lower or nostril portion of the nose. A relatively narrow band of flexible sheet material impervious to the passage of air therethrough is bonded to the filter layer and support layer, the band having one surface bearing removable adhesive material for securing the filter to the nostrils and areas thereearound. The nasal filter may have secured thereto a facial mask portion for night wear, the mask portion comprising a principal portion of flexible material impervious to the passage of air therethrough and having a window portion of a filter layer and one or more support layers secured therein. The borders of the mask portion have an inner layer of adhesive material for attaching the mask portion to the upper lip, jaws and throat of the wearer and the window portion is adapted to be worn over or adjacent to the mouth of the wearer.

4 Claims, 7 Drawing Figures

FACIALLY-WORN BREATHING FILTER

BACKGROUND OF THE INVENTION

This invention relates to facially-worn breathing filters having a filter layer of very fine monolayer metallic mesh, at least one support layer of coarser mesh secured to the filter layer and a border area adapted to be adhesively secured over the nose or over the nose and mouth region of the face.

Prior art masal filters have usually comprised filters of textile or fibrous material worn over the nose or inserted in the nostrils. Known facially-worn filters are usually made of similar materials and usually include a face-contacting portion adapted to space the filter material from the nostrils and the mouth. Such known filter materials, whether chemically treated or not, have proved insufficiently fine-meshed to filter out allergy producing pollens, or fine dust such as coal or harmful asbestos dust without unduly restricting freedom of breathing or being bulky. Moreover, face-contacting portions of the face mask type of filters, if worn tight enough to seat sealingly on the face, are usually uncomfortable to wear for extending periods.

SUMMARY OF THE INVENTION

The present invention contemplates using a filter layer of fine-mesh unilayer metallic mesh made by known methods to comprise mesh with lines as fine as 0.0006 inch in thickness and width and spaced apart in lines as close together as 1000 lines per inch. This fine-mesh material is delicate and fragile and it is contemplated that a coarser mesh be secured to the filter layer as a support layer, by bonding the layers together therearound by strips of plastic resin material or securing the support layer to the filter layer by adhesive or otherwise. The secured-together layers may be shaped to conform to the lower end or nostril area of the nose and may be secured to the nose and upper lip by a layer of adhesive or adhesive-coated material.

One problem with filters so exceedingly fine-meshed, particularly in nasal filters adapted to be worn at the lower surface of the nose, is the resistance to breathing or "drag" of such filters. This may be expressed in terms of transmission area or proportion of open areas between the fine lines of the mesh to the total area covered by the mesh. It has been found that by spacing the lines in one direction, for example the horizontal line, at in excess of 1000 per inch, or 1175 per inch, and more widely spacing the lines in the other direction, the vertical lines, at 450 lines per inch, the drag can be reduced. This, in effect, gives rectangular openings between the strands or lines of the mesh, instead of square openings, and increases the proportion of open area to the total of the mesh.

Such mesh, with rectangular openings, has been successfully made and tested and has an open area proportion of as large as 57% open area as compared to 48% open area for the square opening 1000 × 1000 lines per inch mesh. Tests indicate that similar mesh with lines 350 × 1300 lines per inch can be successfully made.

It will be understood that the terms nasal filter as hereinafter used includes a filter area designed to be secured over both nostrils or separate filter areas for each nostril. For the nostril and filters, adhesive means attach the filter area to the nose-wings around the nostrils, to the end of the septum end and to the upper lip below the nostrils. For separate nostril filters the adhesive attaches each nostril area to the nose wings, to the septum along the nostril and to the upper lip below the nostril.

It will also be understood that mesh with substantially rectangular openings between vertical and horizontal lines refers to lines in two directions substantially perpendicular to one another and without reference to lines in any particular direction in the finished product.

It has been found that in such rectangular opening mesh of non-woven or unilayer construction the lines can be of a width of the order of 0.0006 inch and the breathing resistance or drag is not excessive if the open areas exceed 40% of the filters area. If the lines are spaced apart in one direction less than 0.0009 inch substantially 100% of allergy producing pollens are filtered out.

Support layers have been successfully made and tested wherein the line spacing is 100 × 100 lines per inch and, for the nasal filter, it is contemplated that a support layer be provided on each side of the finer filter layer. The three layers are then bonded together by a comparatively narrow border of bonding material. This bonding material may be an epoxy resin material or material known as iron-on tape. In either case a layer of bonding material is provided on either side of the three mesh layers at the border and pressure and heat are applied in known manner to cause the bonding material to flow through the support layers and to become bonded to the filtering layer.

The support and filtering layers and the border of bonding material may be shaped to fit the contour of the lower end of the nose or around each nostril so that the wearer does not become conspicuous and so that the nasal filter may be worn without discomfort at any time during the day.

The affixing means may be an adhesive which is non-toxic and non-allergic such as colostomy glue, but this requires a special solvent to remove it so an adhesive tape is preferred. So-called double adhesive tape which has an adhesive coating on both sides has been successfully used. The border of the upper side or the nasal side, of the above described nasal filter is covered by a layer of double adhesive tape carefully shaped to conform to the shape of the border area and this affixing means has the advantage of being easily and quickly removed and renewed by new tape shaped in an identical pattern.

The above described nasal filter is not adapted for night use since, during sleep, the wearer loses control of holding his mouth closed. Accordingly a second embodiment called a face mask type of filter has been developed. A nasal filter, as described above, has attached to it a larger filter area adapted to cover the area around the mouth. Around this larger filter area is attached a face mask, like a surgeon's face mask, of flexible material which has been treated so as to be impervious to the passage of air therethrough. A textile treated with flexible rubbery synthetic plastic material or any flexible "waterproof" material may be used. The mask portion is secured to the larger filter area in a manner similar to that with which the border of the above described nasal filter is secured to the filter layers.

The mask portion is then pleated around the filter area in a manner similar to that used in a surgeon's mask so that the portion of the mask in the wearer's mouth area protrudes in front thereof and the edge of the mask portion extends from the upper lip area on either side toward the ears at least as far as the hinge joint between upper and lower jaws. From thence the edge portion is curved to extend down and under the wearer's jaw around his neck. This edge portion is then supplied with an affixing layer which preferably may be double adhesive tape. In this manner air is prevented from entering under the face portion of the mask except through the filter area or areas.

Other face mask structures may be employed with the filter areas above described which have a flexible rubbery portion around the wearer's nose and mouth adapted to keep the' filter areas away from the wearer's mouth. Such a structure is shown in British pat. No. 442,725 issued to Sadd on Feb. 10, 1936. The folded physician's type of face mask is preferred, however, because it is more comfortable to the wearer and because it has the feature of being adhesively secured around its edges to the wearer's face.

A study of various allergy-producing pollens, such as ragweed and goldenrod, was made and it was found that the allergy producing particles of the pollens rarely was as small as 0.0008 inch in diameter. Experiments were then made with woven metal mesh obtainable, plating the mesh to reduce the size of the openings to less than 0.0008 inch across. Even with such plated mesh the drag effect mentioned above was too great.

Drawing then on the printed circuit art, experiments were then made using techniques then known in this art. A monolayer mesh was made by using scribed lines on a glass slide forming a mesh which could be photographically reduced. It was then discovered that, in the spectroscopic art, "ruling engines" were employed to form refraction gratings which could scribe lines sufficiently fine and closely spaced directly on the glass slide. Pure nickel was found to be a satisfactory plating material and could be successfully stripped or peeled from a stainless steel mandrel.

The glass slide was placed over the mandrel which had been coated with a layer about 0.0006 inch thick of non-conductive photosensitive material. Light was then projected through the glass slide and the photosensitive areas under the open areas of the scribed mesh thus exposed was fixed. The photosensitive areas under the scribed marks, not having been exposed to light, were then removed by strip cleaning. The stainless steel mandrel areas thus exposed were then plated with nickel to a height even with the photosensitive material. Successful results were obtained by electroplating and electroless plating which involves thermal agitation or vapor plating.

The very fine and fragile resulting mesh can then be peeled from the mandrel. Thermal variations can be used to first loosen the mesh from the mandrel. The peeled mesh can be further treated by plating or etching but, by using the techniques described above, filter mesh having lines of substantially 0.0006 inch wide and 0.0006 inch thick and spacings of 1175 lines per inch in one direction and 450 lines per inch in the other direction have been successfully made. This mesh has lines which cannot be seen except under a 200 to 300 power microscope but which is slightly transparent and is flexible when properly supported and has a proportion of open areas to the total area of the mesh of about 57% allowing breathing without "drag."

DESCRIPTION OF THE PREFERRED EMBODIMENTS

Figure 1:
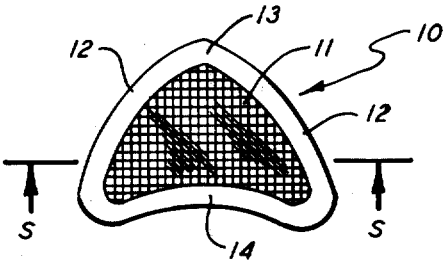
FIG. 1 is a plan view of a nasal filter according to the invention.

Referring to FIG. 1, a nasal filter 10 for daytime wear is shown comprising a multilayer filter portion 11 and a multilayer border portion 12 therearound. The generally triangular outline of the filter portion 11 and its border portion 12 is precisely designed to fit over the lower end, or nostril area, of the wearer's nose. A pointed, or peaked, area 13 is adapted to underlie the outer end of the wearer's septum while the curved sides of the border area are adapted to underlie the nose wings, or flared portions of the nostrils on either side of the septum. The lower side 14 of the filter in FIG. 1 is curved and adapted to be flexed down away from the plane of the paper of the Figure and lie against the wearer's upper lip.

Figure 2:
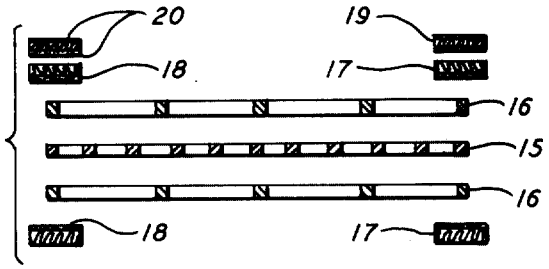
FIG. 2 is an enlarged, exploded, diagrammatic, sectional view of one embodiment thereof on the line S—S of FIG. 1.

Referring now to FIG. 2, the filter area 11 comprises a central filtering layer 15 of fine mesh supported on either side by a support layer 16 of coarser mesh.

The border area 12 comprises a bonding layer 17, on either side of the filter area, of iron-on tape. The surface of each layer 17 adjacent the filter area has been thickened at 18 to signify the adhesive action of the tape 17 when compressed against the filter area and when heat is applied. When the tape layer 17 is ironed on the adhesive portion 18 is forced against the filter area resulting in bonding of the layer 17 not only to the adjacent support layer 16 but also to the central filter layer 15.

The upper surface of the upper layer 17 has secured thereto an affixing layer 19 of double sided tape, the upper and lower surfaces of layer 19 have been thickened at 20 to denote that both surfaces are coated with adhesive.

Figure 3:
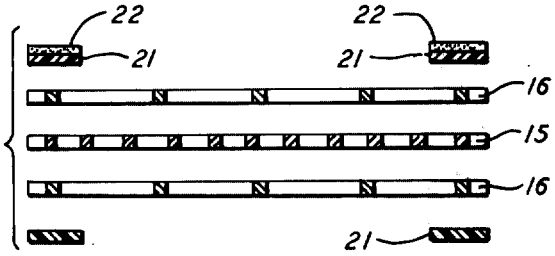
FIG. 3 is a similar sectional view of another embodiment thereof.

Referring to FIG. 3, the filter and support layers 15 and 16 are the same as in FIG. 2 except that they may extend to the outer edges of the bonding layers 21. The bonding layers 21 are formed of epoxy resin which may be bonded to, not only the support layers 16, but also to the filtering layer 15 by the application of pressure and heat in a well known manner.

The upper surface of the upper layer 21 is shown coated with skin cement, and as described above, the alternative use of double sided tape being preferred because of its ease of removal and renewal.

Figure 4:
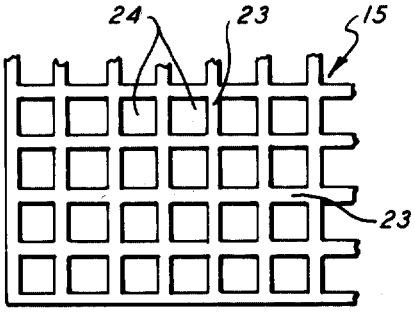
FIG. 4 is a fragmentary, greatly enlarged, diagrammatic plan view of the filter layers of FIGS. 2 and 3.

Referring to FIG. 4, a portion of a filtering layer 15 is diagrammatically shown in plan, microscopically enlarged, as comprising vertical and horizontal lines or portions 23 defining open areas 24 therebetween. The lines 23 are substantially 0.0006 inches in both thickness and width and there are substantially 1000 such lines per inch. The total area of the combined square openings 24 in porportion to the area of a mesh 15 has been found to be substantially 48%. This has been found to cause objectionable drag when the wearer is engaged in strenuous activity but the size of the openings 24 are 0.0006 inches × 0.0006 inches, sufficiently small to screen out the smallest of allergy causing pollens.

The flat nose-end-covering nasal filter is preferred over the types of filter introduced into the nasal passages because of the problem of such filters becoming clogged with mucous.

Figure 5:
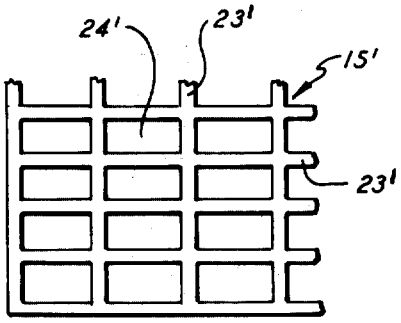
FIG. 5 is a fragmentary, greatly enlarged, diagrammatic plan view of another form of the filter layers of FIGS. 2 and 3.

Referring now to FIG. 5, a portion of a filtering screen layer 15' is diagrammatically shown in plan. The grid lines 23' both horizontal and vertical are again substantially 0.0006 inches both in thickness and in width but the horizontal lines have been ruled spaced 1175 per inch and the vertical lines have been ruled spaced 450 per inch thus causing the openings 24' between lines to be rectangular. This grid spacing has been found to give a proportion of open areas to total filter area of 57% which is entirely satisfactory even when the wearer is engaged in strenuous activity. As techniques for manufacturing this mesh improve it is hoped that spacings of 1300 lines per inch in one direction and 350 lines per inch in the other direction may be reached.

Although the support mesh lines or solid portions of the support mesh layers 16 in FIGS. 2 and 3 are diagrammatically shown as of the same size as those of layer 15, it will be apparent that they are preferably of greater thickness and width for greater support strength and this, of course, presents no problem when the same techniques for ruling these lines are used as those above described for the mesh of layer 15.

As shown in FIG. 1, the lines of the support mesh are of such size as to be visible to the naked eye. This support mesh of layers 16 may be either woven or monolayer, although the latter is preferred.

Figure 6:
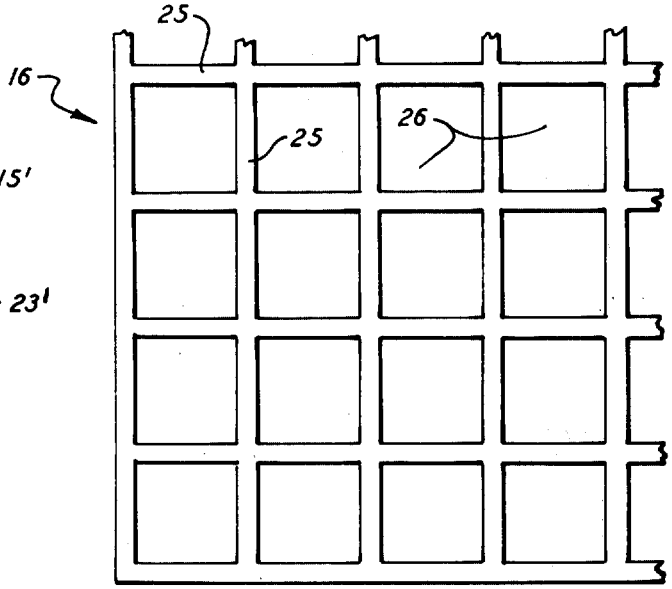
FIG. 6 is a fragmentary, greatly enlarged, diagrammatic view of the support layers of FIGS. 2 and 3.

Referring to FIG. 6, a portion of a coarse mesh of a support layer 16 is shown in plan. The lines or strands 25 run horizontally and vertically with open areas 26 therebetween to form a monolayer mesh and the lines may be such chosen width and thickness as is convenient. The line spacing is 100 lines per inch in each direction as diagrammatically shown in FIG. 1 and are visible to the eye whereas the lines and openings of layer 15 are only visible using a 100 to 200 power microscope.

Similar support mesh, using copper as the plating material, has been made wherein the line spacing is 10 lines per inch or greater, the lines being in excess of 0.0006 inch thick and of a greater width so as to give an open area proportion to the total mesh area of 90%. This forms a flat sturdy support layer which is easily bendable. Only one support layer is used, the support layer being bonded to the filtering layer as by vapor soldering.

Figure 7:
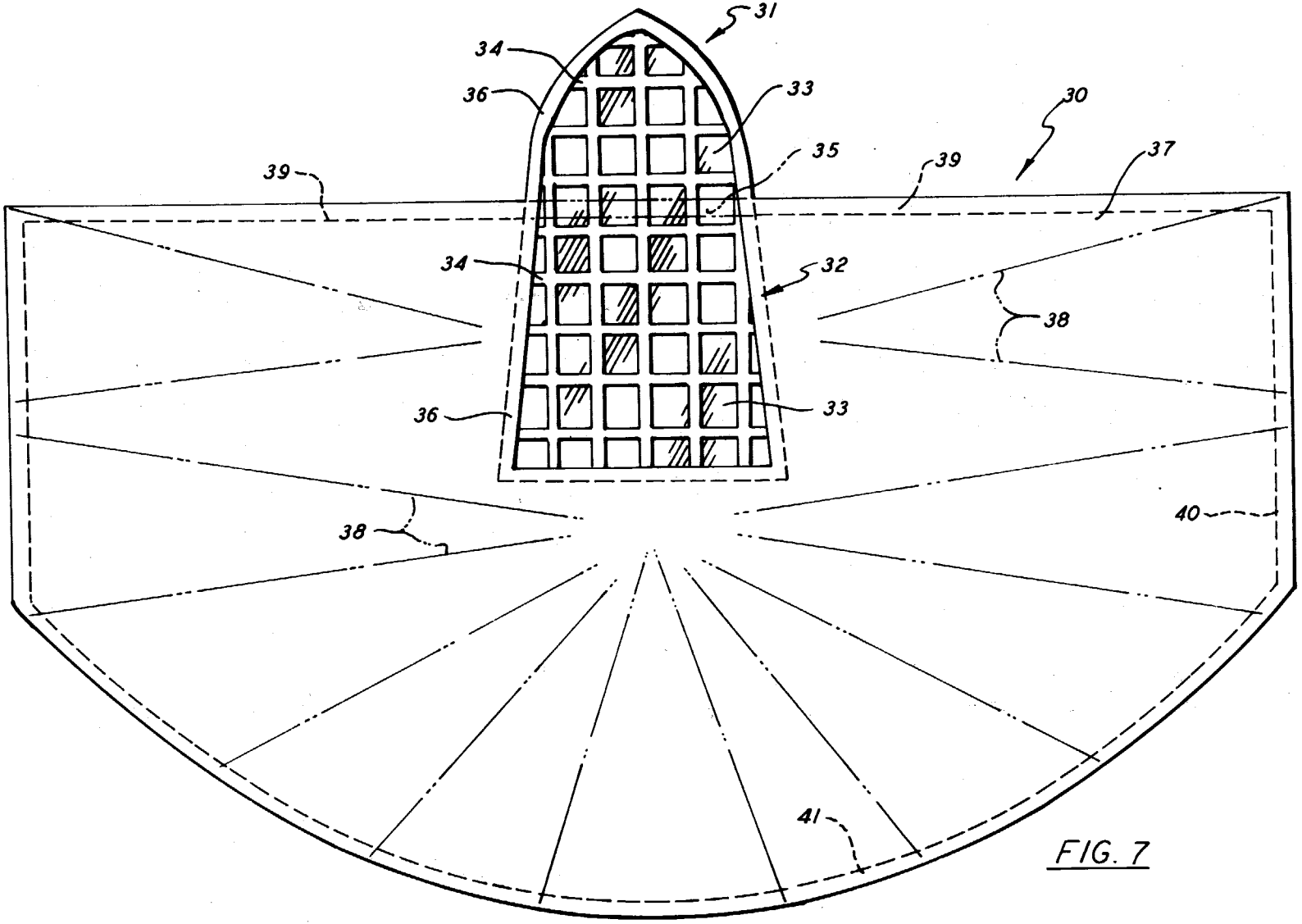
FIG. 7 is a diagrammatic, flattened, plan view of a modified form of filter with a face mask portion thereof shown extended prior to taking tucks therein indicated in broken lines.

Referring now to FIG. 7, a face mask type of filter is shown, suitable for night use in that the filter areas cover both the nostril area and the mouth area. The nostril covering area is shown at 31 and the mouth covering area at 32. These areas may be of the same piece of filtering mesh 33 and support mesh 34, the latter of the type described above wherein the line spacing is 10 lines per inch and the single support mesh layer is bonded or soldered to the filtering layer. Alternatively, the portions 31 and 32 may be spaced on either side of an adhesively coated border strip portion indicated in phantom lines at 35. Portions 31 and 32 are shown flat but it will be apparent that, when the face mask is worn, the nose portion 31 must be bent away from the plane of the paper along the portion indicated at 35.

Both areas are bounded by border areas 36 substantially as shown at 12 and described in connection with FIG. 1. Surrounding the area 32 is a face mask portion 37 shown as flat before tucks indicated at 38 are taken. The mask portion 37 comprises flexible material which is impervious to the passage of air therethrough such as textile material impregnated with flexible plastic material. The border 36 around the area 32 then may conveniently comprise an upper surface layer of the face mask material and an under surface of a strip of iron-on tape.

The upper portion 31 of the filter area may comprise a portion dimensioned and shaped like the nasal filter 10 as shown in FIG. 1 or may comprise a portion, as shown, dimensioned and shaped somewhat like the filter portion 10 but with border areas adhesively coated on the under side with double adhesive tape adapted to fold up over the sides as well as the lower surface of the nose since appearance will play little part for such nightly-worn masks.

The sides 39 of mask portion 37 extend out from the sides of the lower edge of filter area portion 31 and their upper edge may comprise a layer of the material of mask 37 adhesively treated as by a strip of double adhesive tape applied underneath along this edge as indicated by the broken lines 39.

The other edges 40, at either side of mask portion 37, and the curved lower edge 41, after the tucks indicated at 38 are taken, also may have a strip of double adhesive tape, indicated at 40 and 41, applied to the under surface after the edges have been tucked and trimmed to the desired configuration.

This tucking as well known to those familiar with surgical masks and it will be understood that the tucks make the center of the mask portion 37 stand out in front of the face while the edges 39 extend from the wearer's upper lip back to a point near the joint between upper and lower jaws. The edges 40 and 41 then extend downward and around the wearer's throat and all these edges are sealed to the wearer's skin by the double adhesive strips indicated at 39, 40 and 41 ensuring that all air to the wearer passes through the filter portions 31 and 32.

Alternatively, of course, the material of the portion 37 may also completely surround the area 31 as well as area 32 so as to extend up to the bridge of the wearer's nose and the upper edges 39 may extend transversely and slightly downward to the region of the joint between upper and lower jaws. The edges, of course, are coated with adhesive to seal the mask portion to the wearer's face. Thus there is a single window of filtering and support layers surrounded by the mask portion 37.

I claim:

1. A breathing filter adapted to be secured over at least one facial breathing orifice of a wearer, the filter having at least one filter area comprising a comparatively fine filtering area of a metallic monolayer mesh the mesh being formed of wires extending in lines in two directions at substantially 90° to one another, the wires being spaced apart about substantially rectangular openings between portions where the lines cross, the wires being substantially rectangular in cross section adjacent the openings and of the same single thickness where the lines cross, the metal wires being less than 0.0009 of an inch in thickness and in width around the openings and the wires in at least one direction being spaced apart less than 0.0009 of an inch at each opening, the sum of the open areas of the openings in the filter area being at least 40% of the total filter area, the filter area having at least one supporting layer of a comparatively coarse metallic mesh secured to the filtering mesh, the filtering area having therearound flexible sheet material impervious to the passage of air therethrough, the flexible sheet material being bonded to the edges of the filtering and support layers, and the outer edges of the sheet material having one surface bearing adhesive for bonding the sheet material outer edges to the skin of the wearer around the breathing orifice.

2. A nasal filter adapted to be secured over the lower, nostril end of a wearer's nose, comprising: a comparatively large filter portion and a comparatively narrow border portion therearound of flexible material impervious to the passage of air therethrough, the combined filter and border portion being generally triangular with curved sides and precisely shaped and dimensioned to fit over the nostril end of the wearer's nose by taking an impression of the nose end and measuring it, the lower border portion being of sufficient width to be adapted to be turned down for contact with the wearer's skin below the nostril end, the filter portion having a filtering layer of metallic monolayer mesh being formed of wires extending in lines in two directions at substantially 90° to one another, the wires being spaced apart about substantially rectangular openings between portions where the lines cross, the wires being substantially rectangular in cross section adjacent the openings and of the same single thickness where the lines cross, the metal wires being less than 0.0009 of an inch in thickness, and in width around the openings and the wires in at least one direction being spaced apart less than 0.0009 of an inch at each opening, the sum of the open areas in the filtering layer being at least 40% of the total filtering layer area, the filtering layer having at least one supporting layer of a comparatively coarser metallic mesh secured to the filtering layer, the support and filtering layers having their edges bonded to the border portion, the border portion having one surface bearing adhesive for bonding the border portion to the skin of the wearer around the nostril end of the nose.

3. The nasal filter as defined in claim 2 in combination with a face mask, the face mask filter combination having a filter portion and a mask portion of flexible material impervious to the passage of air therethrough, the nasal filter portion having an integral extension comprising a filtering layer and at least one supporting layer secured thereto, the mask portion having a window portion whose edges are bonded to the edges of the layers of the extension, the mask portion having an upper straight edge extending laterally 2½ to 4 inches on either side of the extension filter and arcuately curved side and bottom edges gathered in tucks therealong for forming a concavo-convex shape of mask of which the concave surface constitutes the inner surface of the mask, the inner surface of the mask upper, side and lower edges bearing adhesive therealong for sealed engagement with the skin of the wearer when worn and whereby air breathed by the wearer through nose and mouth is filtered through the filtering layers.

4. A combination face mask and breathing filter means, the filter means including a nasal filter and a mask filter each having a filtering portion and a border portion, each filter having a filtering area comprising a filtering layer of a comparatively fine metallic monolayer mesh and at least one coarser metallic mesh support layer secured to the filtering layer, the filtering layer mesh being formed of wires extending in lines in two directions at substantially 90° to one another, the wires being spaced apart about substantially rectangular openings between portions where the lines cross, the wires being substantially rectangular in cross section adjacent the openings and at the same single thickness where the lines cross, the metallic wires being less than 0.0009 of an inch in thickness and in width around the openings and the wires in at least one direction being spaced apart less than 0.0009 of an inch at each opening, the sum of the open areas in the filter area being at least 40% of the total filtering area, the nasal filter having around its filtering area a comparatively narrow border of sheet material impervious to the passage of air therethrough, the border being bonded to the filtering and support layers therearound, the combined filter and border of the nasal filter being generally triangular with curved sides precisely shaped and dimensioned to fit over the nostril end of the wearer's nose by actual measurement, the border of the nasal filter having one surface bearing adhesive material for sealed engagement of the border to the skin around the wearer's nose nostril end, the face mask being of flexible sheet material impervious to the passage of air therethrough, being secured to the lower edge of the nasal filter border, and having a hole therethrough adjacent the nasal filter, the mask hole edges comprising the mask filter border being bonded to the edges of the layers of the mask filter edges, the face mask having an upper straight edge extending laterally 2½ to 4 inches on either side of the nasal filter bottom edge and having arcuately curved side and bottom edges gathered in tucks therealong for forming a concavo-convex shaped mask of which the concave surface thereof constitutes the inner surface of the mask; the inner surface of the mask upper, side and lower edges bearing adhesive therealong for sealing engagement with the skin of the wearer when worn and whereby air breathed by the wearer through nose and mouth is filtered through the filtering layers.

* * * * *